US011389774B2

(12) United States Patent
Rubiales Vázquez et al.

(10) Patent No.: US 11,389,774 B2
(45) Date of Patent: Jul. 19, 2022

(54) FLUID MIXING DEVICE

(71) Applicant: LESIELLE COSMETICS, S.L., Jerez de la Frontera (ES)

(72) Inventors: Ruben Rubiales Vázquez, Jerez de la Frontera (ES); Alberto Portillo González, Jerez de la Frontera (ES)

(73) Assignee: LESIELLE COSMETICS, S.L., Jerez de la Frontera (ES)

( * ) Notice: Subject to any disclaimer, the term of this patent is extended or adjusted under 35 U.S.C. 154(b) by 237 days.

(21) Appl. No.: 16/618,470

(22) PCT Filed: Jun. 1, 2018

(86) PCT No.: PCT/ES2018/070400
§ 371 (c)(1),
(2) Date: Dec. 2, 2019

(87) PCT Pub. No.: WO2018/220254
PCT Pub. Date: Dec. 6, 2018

(65) Prior Publication Data

US 2021/0008515 A1 Jan. 14, 2021

(30) Foreign Application Priority Data

Jun. 1, 2017 (ES) ..... ES201730755

(51) Int. Cl.
*B01F 15/00* (2006.01)
*B01F 35/32* (2022.01)
(Continued)

(52) U.S. Cl.
CPC ..... *B01F 35/3204* (2022.01); *B01F 35/2112* (2022.01); *B01F 35/45* (2022.01); *B01F 2101/21* (2022.01)

(58) Field of Classification Search
CPC ..... A45D 40/24; A45D 2200/054; A45D 2200/055; A45D 2200/058;
(Continued)

(56) References Cited

U.S. PATENT DOCUMENTS 7,445,372 B1 4/2008 Engel et al.
2016/0101395 A1 4/2016 Hussain
(Continued)

FOREIGN PATENT DOCUMENTS

WO 0191601 A2 6/2001
WO 2016087468 A1 9/2016

OTHER PUBLICATIONS

International Search Report, PCT/ES2018/070400, dated Oct. 15, 2018.

*Primary Examiner* — Elizabeth Insler
(74) *Attorney, Agent, or Firm* — Porzio Bromberg & Newman P.C.

(57) ABSTRACT

The invention relates to a fluid mixing device which mixes a base fluid with one or more additive fluids coming from respective containers, said device being characterised in that it is quick and easy to use and in that no traces are left between uses. The device comprises a first module (1) for extracting at least one first fluid contained in at least one base fluid container (23), a drag, extrusion and discharge mechanism (2), a second module (3) for extracting one or more second fluids or additive fluids from one or more additive containers (24), a mixing tank (4) provided with a hole for the discharge of the final mixture, a battery-powered electronic control board (27), wherein a single stepper motor is used for applying pressure to the base fluid container and the additional fluid container(s), and the drag, extrusion and discharge mechanisms (2) are actuated.

10 Claims, 14 Drawing Sheets

(51) Int. Cl.

| | |
|---|---|
| ***B01F 35/21*** | (2022.01) |
| *B01F 35/45* | (2022.01) |
| *B01F 101/21* | (2022.01) |

(58) Field of Classification Search

CPC ..... B01F 2215/0031; B01F 13/1055; B01F 33/84; B01F 33/841; B01F 33/844; B01F 33/85; B01F 35/71745; B01F 35/754251; B01F 35/3204

See application file for complete search history.

(56) References Cited

U.S. PATENT DOCUMENTS

| | | | | |
|---|---|---|---|---|
| 2016/0270511 | A1 | 9/2016 | Wee | |
| 2017/0208920 | A1* | 7/2017 | Thiebaut | A45D 44/005 |
| 2017/0340087 | A1* | 11/2017 | Samain | B05C 17/0103 |

* cited by examiner

FLUID MIXING DEVICE

OBJECT OF THE INVENTION

As indicated in the title, the object of the present invention is a fluid mixing device which, in a possible non-limiting embodiment, may be the mixture of one or more additive fluids or active fluids with a base fluid, where it is not necessary for one of the fluids to act as the base fluid, that is, there is no limitation whatsoever to the amount, proportion and nature of the fluids involved in the mixture. Among the numerous features of the device object of the invention is that of making cosmetic creams.

The present invention is comprised within a context of personalisation in all end consumer sectors, giving added value to the product that is tailored to said consumer.

In this case, the invention covers the demand for personalised cosmetic creams, creating a device which enables the personalised cosmetic treatment to be obtained instantly and at home. Furthermore, as a result of the technical solution applied, the user can modify the personalised cream each time his or her needs change.

The user chooses the characteristics of the cosmetic cream separately: moisturising level, according to the type of skin, texture and treatment, signs to be treated. This is summarised by choosing a base cream which provides moisture and texture, and active ingredients for treatment, all in 50 ml airless-type containers for the base and 5 ml for the active ingredients. These bottles are introduced in the device of the invention and by simply pushing a button, the single dose of a personalised cosmetic cream for that time is obtained.

The present invention is characterised by the special configuration and design of each of the elements that are part of the mixing device, achieving a fluid mixing device which enables the fluids to be treated independently, which in a possible embodiment could be what is referred to as base fluid and additive fluid or fluids, while, as previously stated, there is no limitation whatsoever as to the amount, functionality and nature of each fluid. The mixing device object of the invention is characterised in a very important manner with respect to that existing in the state of the art in that no traces are left when containers are interchanged, that is, it allows replacing fluids with others without having to clean the device.

Other characteristic aspects of the device are; its small size which, combined with being battery-operated, makes it readily portable and easy to handle for the user, and it presents simplicity in use, comfortably interchangeable bottles and an intuitive and clean information panel through LED lights.

Therefore, the present invention is comprised within the scope of mixing devices for mixing a series of fluids which are particularly conceived for preparing cosmetic creams.

BACKGROUND OF THE INVENTION

The following mixing devices are known in the state of the art.

Patent publication US2016/0052007 A1 discloses a device which can be seen at https://www.nuskin.com/enPL/ageloc-me-landing.html, said device having aspects susceptible to improvement, such as the fact that it does not distinguish between base fluids and additive fluids so that they can be treated and supplied independently. It is an embodiment that is different both structurally and functionally from what is proposed herein.

Patent publication WO14080093, which corresponds with a device described at http://www.romy-paris.com/; in this case, the mixture is obtained from single-use capsules, and the system is different from what is proposed in the present application.

Patent publication U.S. Pat. No. 7,445,372, which discloses a device for mixing and dispensing liquid compositions, including an arrangement of components that provide an efficient dispenser for home and personal use. The device may include a plurality of cartridges and a plurality of pumps. Each of the cartridges contains a liquid additive and may be removably attached to the dispenser. Each of the pumps is connected to one of the cartridges and can be activated to extract the desired amount of liquid from that cartridge. The device may also include a spinning element for both mixing and dispensing the liquid composition. The liquids may flow out of the cartridges to one or more inlets near the surface of the spinning element and be mixed as they flow over the surface of the spinning element.

The extraction, mixture and discharge system is complex and expensive to manufacture, requiring both pumps and cartridges or supply devices, resulting in a complex device in terms of its construction and complex in terms of its handling; furthermore, it does not feature any means or design whatsoever conceived for reducing or leaving no traces in the use of the device.

Patent publication US 20060000852 A1, which discloses a portable dispenser for mixing and dispensing fluid mixtures, which contains a main chamber and other auxiliary chambers. It has the drawback that if it is to be used for another type of mixture, it does not feature means that are especially designed to avoid leaving a trace.

Most of the known fluid mixers perform mixing in a drum, thereby being contaminated for other different future mixtures, since they leave traces.

Patent publication WO 2016087468, which discloses a dispensing system for delivering a mixture of variable colour, which has no extraction module whatsoever, no drag mechanism or automated mixing mechanism. It shows an embodiment that is completely unrelated to the object herein proposed.

Therefore, an object of the present invention is to overcome the mentioned drawbacks, in particular, the traces that may be left by making the mixtures, in addition to the complexity, the lack of making a mixture from several fluids, and the fact that in a possible embodiment one or more additive fluids could be added to a base fluid, and furthermore, the inability to use standard containers from the industry, developing a device such as the one described below and the essential features of which are included in claim 1.

DESCRIPTION OF THE INVENTION

The object of the invention is a fluid mixing device, in which the user can configure through independent means all the desired features of the final mixture through a rapid and simple method. The device seeks to enable mixing several fluids independently which, in a non-limiting possible embodiment, could be a base fluid and one or more additive fluids, both fluids being treated and controlled independently.

Each of the fluids to be mixed is contained in independent containers, generally having standard features, such that one container can be replaced with another having similar features.

The device object of the invention enables the contents to be extracted from each of the different containers, in the previously programmed amounts, homogeneously mixing them in a common mixing tank where, through a mechanical pushing method, they are mixed by extrusion and the end product is finally discharged, all such that no traces of the fluids used in the mixture are left.

The extraction of the different fluids is performed by means of a mechanical system that simulates the user pressing it and will in turn serve to drag, mix and discharge the mixture. This mechanism consists of the container being fixed, a pressure platform, guides and movement transformers which are driven through a single stepper motor.

All the fluid containers are readily accessible and replaceable with others.

Each of the discharged fluids is placed in a common mixing tank. Through a mechanical traction-compression pushing method, where a rack and pinion-type mechanism is used, performing both traction and compression, the fluids are mixed by extrusion, achieving a homogenised mixture in terms of element distribution.

The process of discharging all the fluids placed in the mixing tank is by means of an extrusion process, in which the generated mechanical pushing is utilised to pass independent fluids through a common hole, without this process affecting their independent features.

The final mixture is discharged, using the same extrusion mechanism, through the outlet hole, which is provided with a support and allows the user to access the mixture that is made, which is perfectly mixed and homogenised.

As a result of this drag and extrusion system, a homogeneous mixture is provided in the final support for application by the user and the internal area is left without traces for the following use.

All these mechanisms are managed by a battery-powered electronic control board (acting as the global CPU of the system). In addition to that set forth, the system is provided with a container level detection system, notifying the user when one of them is running out, and with connectivity for managing this data through a mobile telephone.

The container level detection systems are two electronics boards (one for the base container and the other for the active ingredient containers) in which there are included a system of light emitters and photoresistors which, according to the container level, indicate the container level since they are translucent. This information is transmitted to the CPU, which is in charge of managing the information and emitting the signals to the user through LED lights.

These LED lights are only visible through the casing when they light up, with the surface being completely clear of projections and recesses. Also, the button, which is capacitive, is below the outer casing. In said casing there is a slit for the user to know where it is located, thus leaving the surface clear. This configuration is defined in this manner so as to ensure easy cleaning and use of the device, in addition to suitable ergonomics for the end user, where forces need not be exerted nor are complicated manuals needed to understand how the device works.

These containers, which could be adapted to different sizes and shapes, discharge their contents through mechanical means which simulate a normal user pressing on the containers.

The mixing device comprises an outer casing provided with a front door for access to the inside, to thus replace and place both the additive containers and the base fluid container.

The mixing device features two container anchoring modules, one for the base and the other module for the additives, and a mechanism which, being completely synchronised, performs the functions of: retracting the drag system, compressing both the base container and the additive containers, dragging along the mixing tank, extruding the additive and base components, and finally discharging it for the user, in said order.

Furthermore, it also features a mixing tank provided with a hole for the discharge and housed between both modules. Therefore, when the products are discharged from the base fluid container and from the additive container(s), all the products are mixed together by means of a drag mechanism, which performs the functions of extruding and finally discharging the mixture.

Said drag mechanism consists of a rack and pinion system, in which the rack is part of what is referred to as the drag element. This part performs piston-type functions, thus always covering the entire section of the mixing tank, and therefore dragging all the fluids which are placed therein during the use cycle. This drag element is made up of a rigid part where the rack is located, and an elastic part, made of silicone in a preferably but non-limiting manner, which will enable adjustment in the mixing tank and subsequent extrusion of the mixture.

The mixing device with a single stepper motor achieves on one hand lifting the base container which, when pressed against the mixing module, causes the discharge of its contents into a mixing tank; on the other hand, also when the additional fluid containers are pressed due to the lifting of the mixing container, they discharge their contents into the mixing tank, a drag, extrusion and discharge mechanism also operated by said stepper motor being associated with said mixing tank.

The following is achieved with the device object of the invention:

- Individual containers (standard containers in the industry, specifically airless-type containers), which can be treated independently.
- The mixing cycle has no type of resilience, thus when interchanging the containers there is no trace of the preceding one.
- The mixing and discharge process lacks any latency, that is, there is no wait time whatsoever after installing the containers.
- The mixing and extraction system is through simple mechanical means.
- The interchanging of containers or cartridges leaves no trace, so it could be used for as many different combinations as desired, without having to clean or perform any other prior action. In a complementary and optional manner, the common mixing tank can be removable if it were to be subjected to a washing and disinfection process.

The mixing device can be applied in different fields, ranging from the production of cosmetics to the preparation of paints, dyes, etc.

Unless otherwise indicated, all the technical and scientific elements used in the present specification hold the meaning that is usually understood by one having average skill in the art to which this invention belongs. In carrying out the present invention, methods and materials that are similar or equivalent to those described in the specification can be used.

Throughout the description and the claims, the word "comprises" and its variants do not intend to exclude other technical features, additives, components or steps. For those skilled in the art, other objects, advantages and features of the invention will be inferred in part from the description and in part from the practice of the invention.

DESCRIPTION OF THE DRAWINGS

To complement the description that is being made and for the purpose of helping to better understand the features of the invention according to a preferred practical embodiment thereof a set of drawings is included as an integral part of said description in which the following has been depicted in an illustrative and non-limiting manner.

PREFERRED EMBODIMENT OF THE INVENTION

A Preferred Embodiment of the Proposed Invention is Described Below in View of the Figures.

Figure 1:
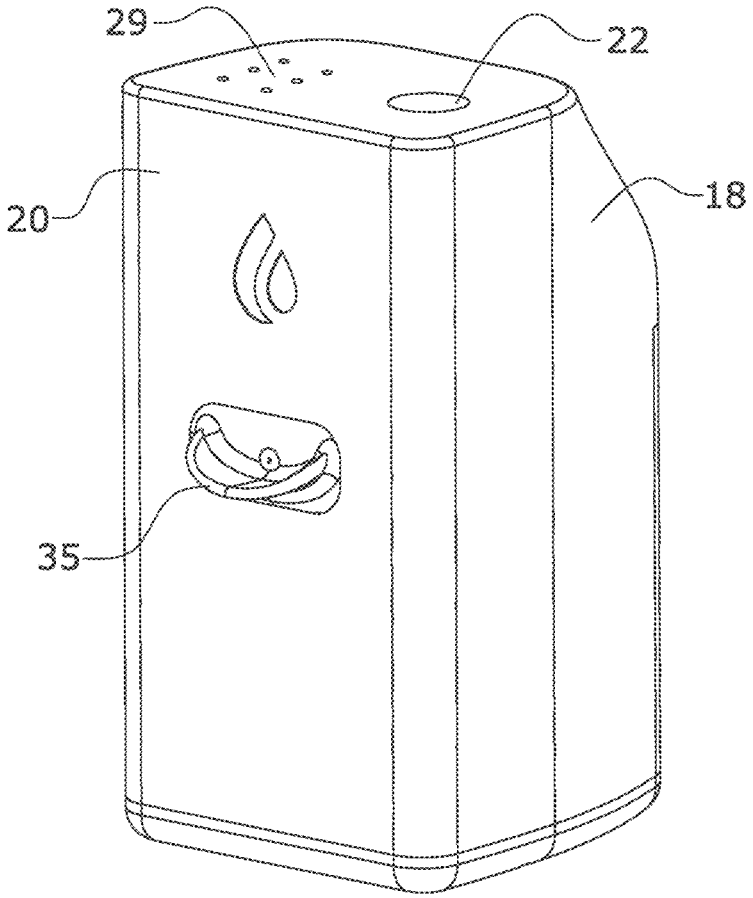
FIG. 1 shows an isometric perspective view of the device.

In FIG. 1, it can be observed that the device object of the invention comprises an outer casing or housing (18) provided with a front access (20). Furthermore, there is a dispensing tab (35) for dispensing the final mixture, as well as indicator LEDs (29) indicating the operating state of the device. It also features a button (22) to actuate the mixing and dispensing process.

Figure 1A:
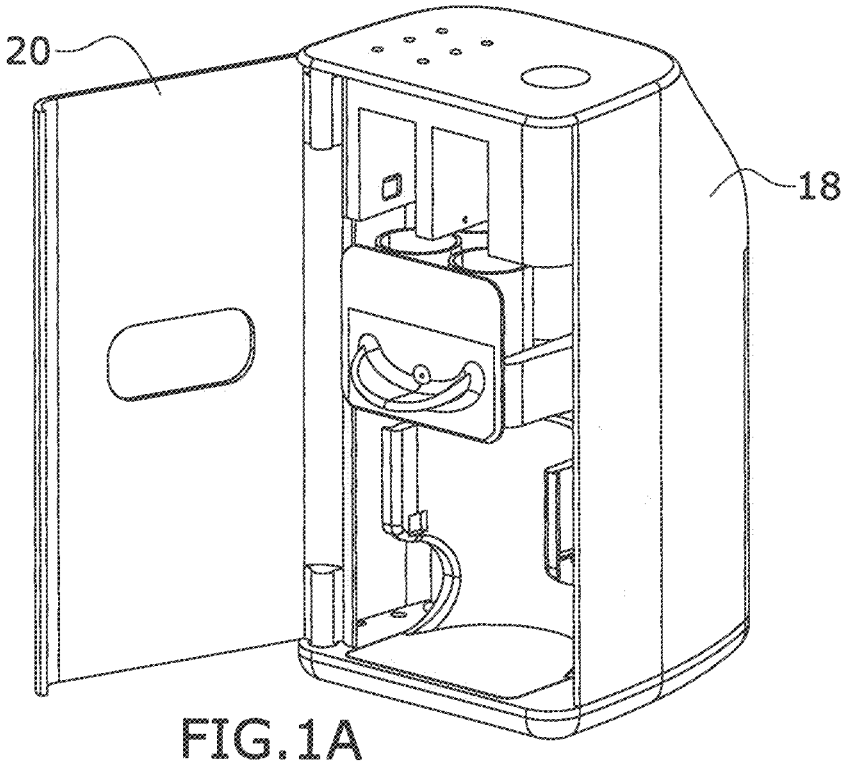
FIG. 1A shows how to access the base and additive containers in the device.

In FIG. 1A, the complete system with its only front door (20) in the open position and the front area for user interaction with the device can be observed, where the base and additive containers can be interchanged.

Figure 1B:
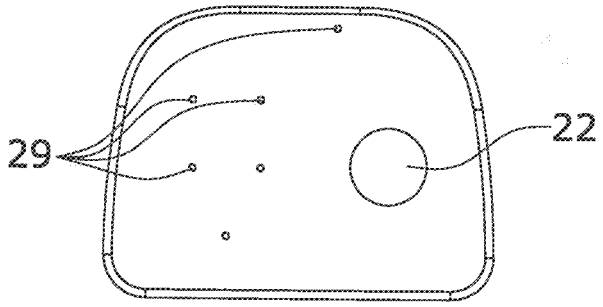
FIG. 1B shows the indicator elements and button whereby the user interacts with the device.

FIG. 1B shows the position of the battery and container level indicator LEDs (29) in the upper surface of the outer casing (18). These are the positions of the LEDs, which are only visible through the casing when they light up, with the surface being completely clear of projections and recesses. Also, the button (22), which is capacitive, is below the outer casing (18) and in it there is a slit for the user to know where it is located.

Figure 2:
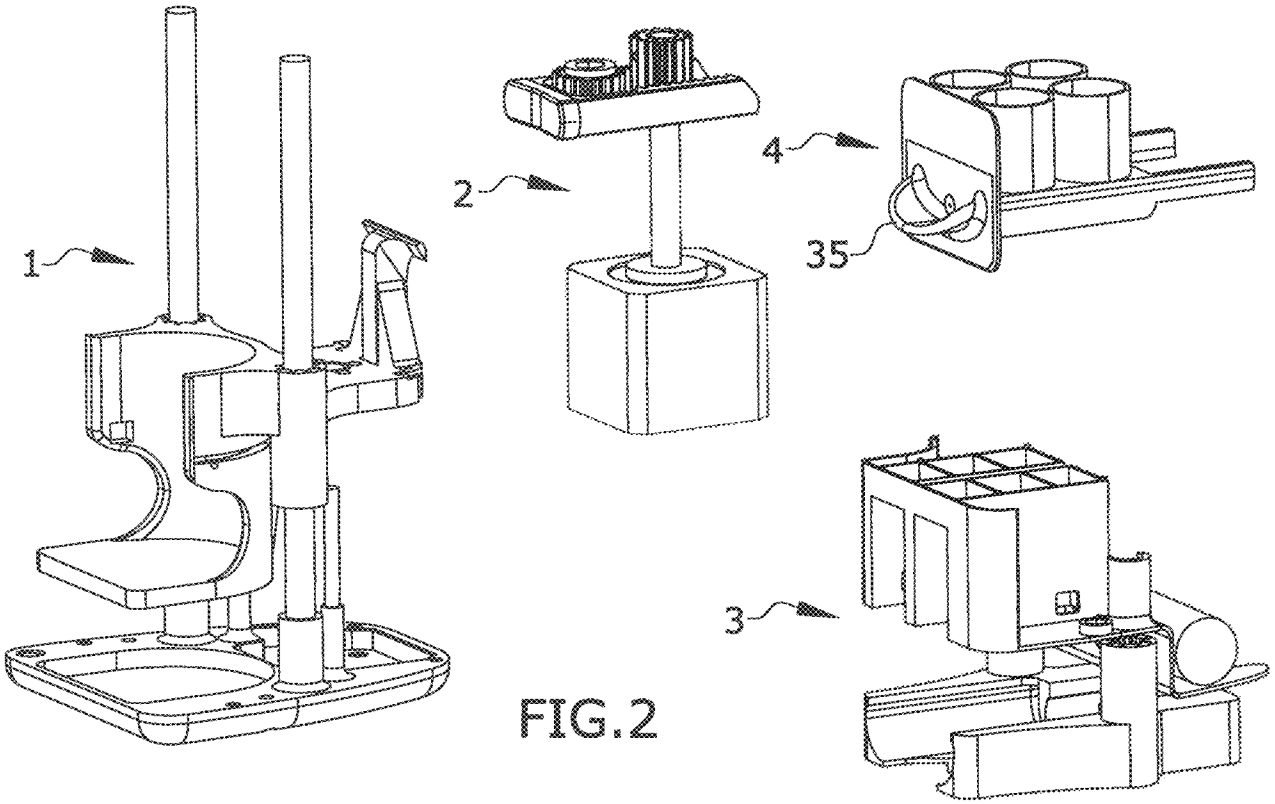
FIG. 2 shows a diagram of the modules comprised in the device.

The main modules of the device and how they are housed inside the casing (18) (FIG. 1) can be observed in FIG. 2. Said modules are:

- A first module (1) for extracting a first fluid or a base fluid from a base fluid container (23) (FIG. 5) which contains said first fluid or base fluid.
- A drag, extrusion and discharge mechanism (2) of the final mixture, hereinafter referred to as drag mechanism (2) for the sake of simplification.
- A second module (3) for extracting second fluids or additive fluids of additive containers (24) (FIG. 8)
- A mixing tank (4) provided with a hole for the discharge of the final mixture which is connected with the dispensing tab (35).

The drag mechanism (2) is arranged inside the mixing tank (4) and the latter is fixed to the second module (3).

In a complementary manner, the mixing tank (4) can be detached and removed from the rest so as to enable being washed and disinfected if considered necessary.

The complete mechanism and the sensor and button data acquisition are independently managed by a main electronics board, which allows regulating the amount of base fluid and additive fluid.

Figure 2A:
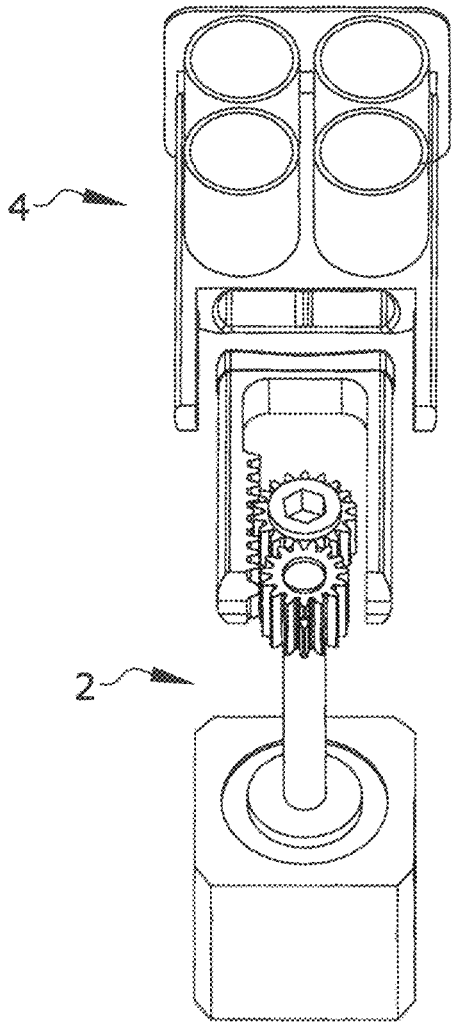
FIG. 2A shows in detail how the drag modules and mixing tank interact.

The nature of the drag system (2), which works like a piston traveling along the entire section of the mixing tank (4), which also has the function of housing the additive containers (24) (FIG. 8) while they are located in the device, can be observed in FIG. 2A.

Figure 3:
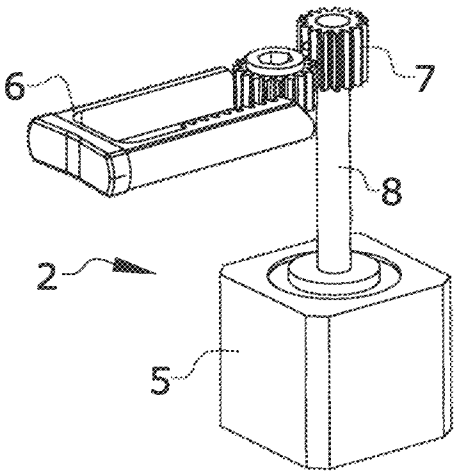
FIG. 3 shows the drag, extrusion and discharge module of the final fluid.

FIG. 3 shows a detail of the drag mechanism (2) comprising a stepper motor (5) which causes rotation of the main gear (7) of the motor (5) by transmission through the spindle (8). This rotation of the main gear (7) causes rotation of the gear of the drag element (9) which is fixed to the second module (3) (FIG. 2) through a screwed shaft (10) and enables it to engage with the rack of the drag element (6), thus producing sliding in the drag, extrusion and discharge direction of the drag element.

Figure 4A:
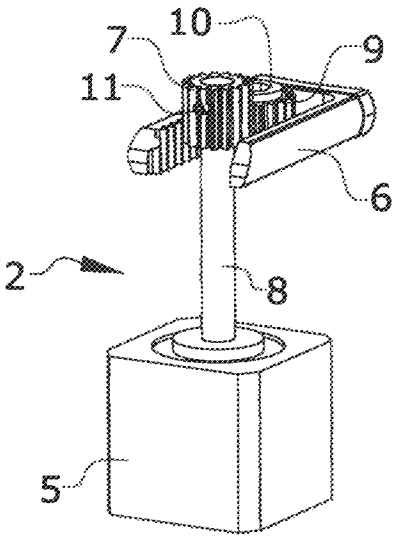
FIG. 4A shows a detail of how to fix the components in the drag mechanism.
Figure 4:
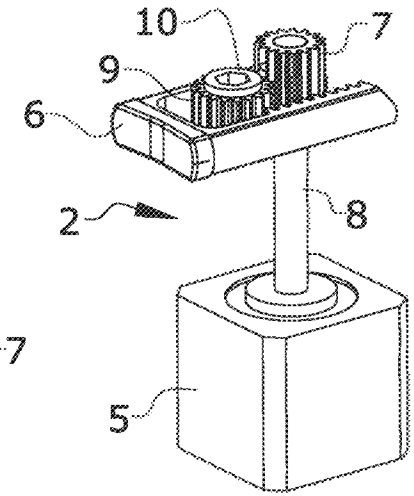
FIG. 4 shows the drag and extrusion mechanism in the drawn hack or folded position.

FIG. 4 shows a detail of the drag mechanism (2) withdrawn by the action of the stepper motor (5), which causes rotation of the main gear of the motor (7), this time in the sense opposite the drag direction, by transmission through the spindle (8). This rotation of the main gear (7) causes rotation of the gear of the drag element (9) which is fixed to the second module (3) through a screwed shaft (10) and allows it to engage with the rack of the drag element (6), thus producing the withdraw in the opposite sense of the drag direction.

FIG. 4A shows the anchoring of the main gear (7) with the spindle (8) through a headless screw (11) which passes through the borehole made in both parts, causing a completely integral movement between them.

Figure 5:
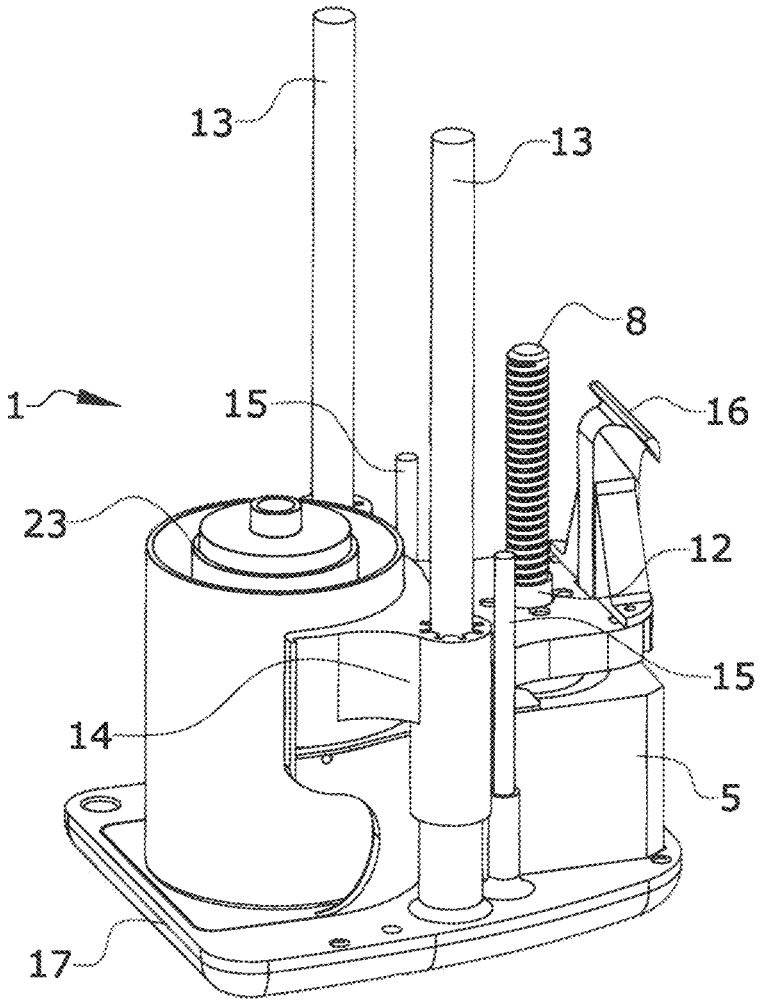
FIG. 5 shows a detail of the base fluid extraction module by pressing the container.

FIG. 5 shows the first module (1) for extracting a base fluid from the base fluid container (23) consisting of a system for fixing same which also acts as a lifting platform (14) during compression and a resting platform during relaxation. This movement occurs as a result of the rotation of the stepper motor (5), which turns the spindle (8) that transmits such rotation to a nut (12) anchored in the lifting platform (14) and transforms the rotation into an upward or downward linear movement according to the direction of rotation. This platform is supported on two guides (13) which restrict movement to vertical movement and are fixed to the base of the module (17). There are brakes (15) to make the second module (3) stop, where said brakes (15) are also anchored to the base (17) of the module (1). Lastly, the pusher of the drag element (6) which is in charge of engaging and disengaging the drag element during the operating cycle is fixed, allowing compression of the tanks with the drag element being completely withdrawn and discharged at the end of the cycle.

The compression of the base container (23) is exerted on the second module (2) positioned right on it; furthermore, the latter fits with the mixing tank (4) where the base fluid is discharged.

Both the base fluid containers) and additive fluid container(s) are kept pressed until the drag element passes, and once it has passed they are no longer pressed.

Figure 6:
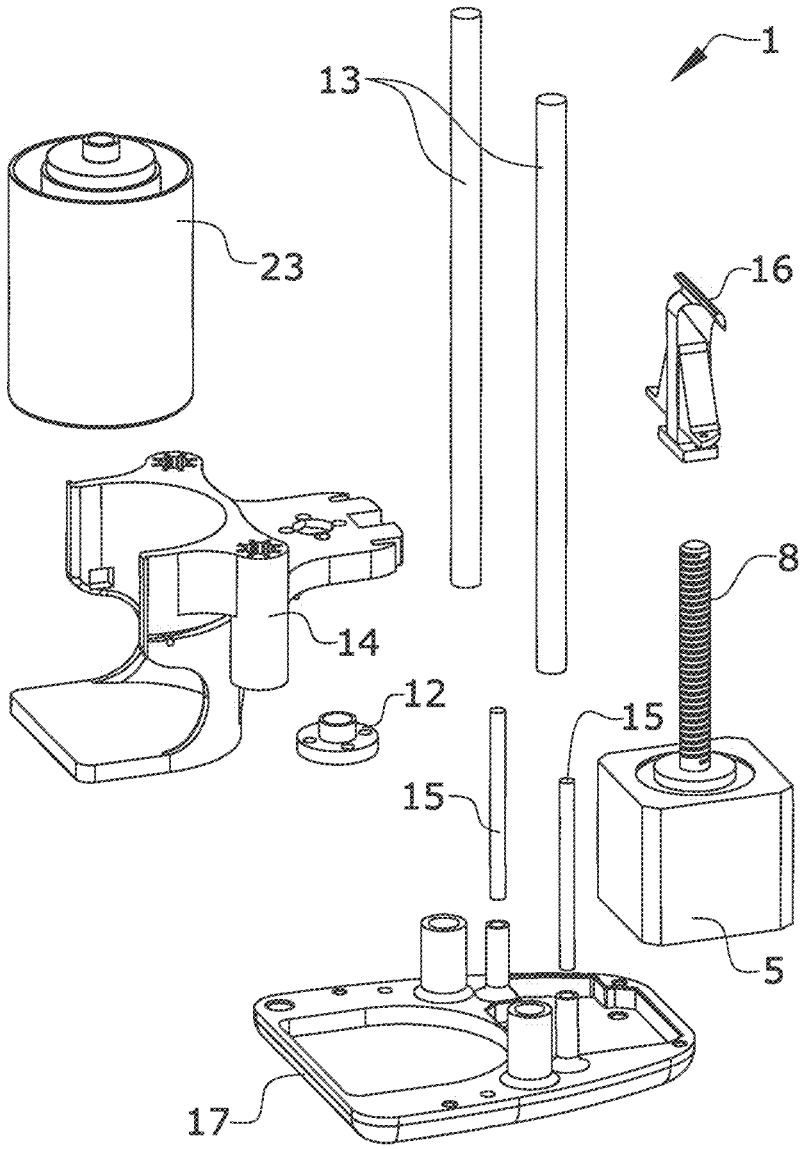
FIG. 6 shows an exploded view of the base fluid extraction system.

FIG. 6 shows an exploded view of said first module (1), which comprises:

- a base (17).
- guides (13) fixed to the base (17).
- a platform (14) movable in the vertical direction along the guides (13) by the action of a spindle (8) and a nut (12) which transform the rotation of the stepper motor (5) into a lifting and lowering movement of the platform (14).
- stops (15) for limiting the lifting movement of the platform (14), said stops (15) being fixed to the base platform (17).
- a part (16) which couples and decouples the drag element (6) during the cycle so that the tanks can be compressed when it is completely deployed and discharged when they are still compressed.

The so-called base fluid does not have to be limited to a single fluid, and more than one base fluid container can be arranged and each of the base fluids managed either simultaneously or independently.

Figure 7:
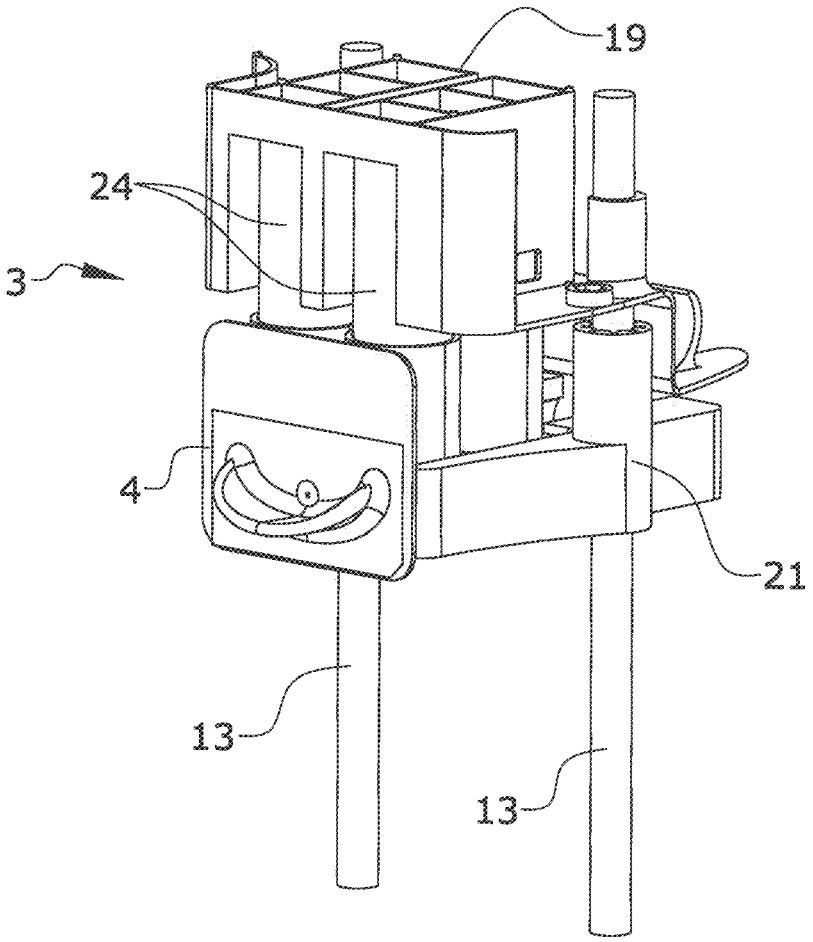
FIG. 7 shows the additive extraction diagram.

FIG. 7 shows the second module (3) for discharging the additive fluids (24) and comprising a lifting and lowering platform (20 of the mixing tank (4), which also performs the function of fixing the additive tanks (24), and an additive stop part (19) anchored to the outer casing (18) (FIG. 1), which causes the additive tanks to be completely pressed. Said pressure is exerted by the first module (1) during its upward movement supported on the guides shared by both modules (13). The lifting and lowering platform (21) corresponding to the second module (3) also acts as a support for a portion of the drag system (2), since it is integral with the mixing tank (4).

Figure 8:
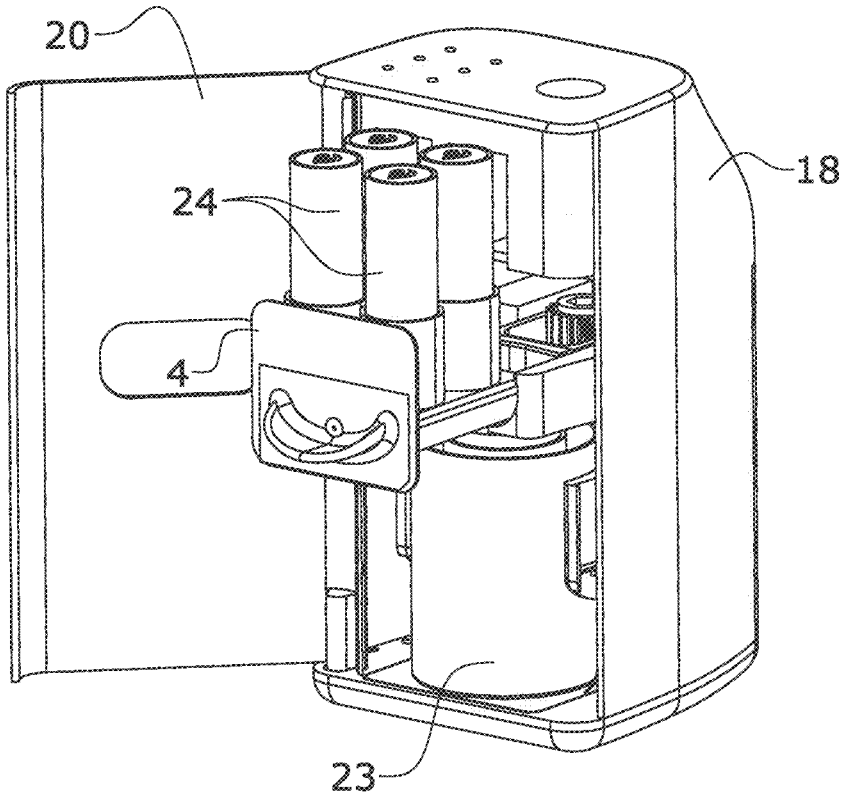
FIG. 8 shows the device with the accesses to the inside open and how to interchange the additive and base containers.

FIG. 8 shows how to access the inside of the device and interchange additive containers (24) and base fluid container (23). This system comprises the front door (20), which serves for directly accessing first module (1) and accordingly the base container (23) by introducing one's hand, and the partial retraction of the mixing tank (4), which allows interchanging the additive containers (24) in the vertical direction.

Figure 9:
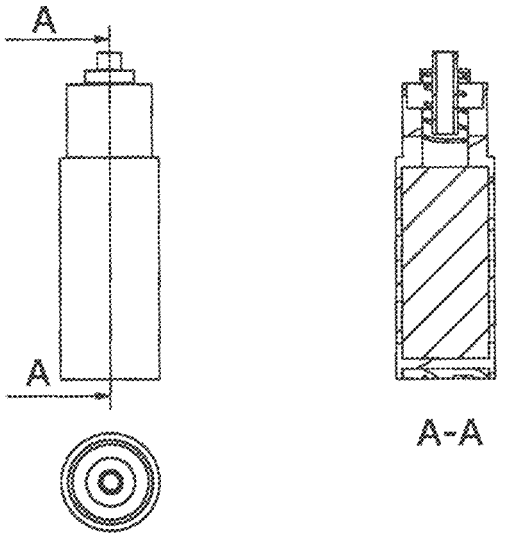
FIG. 9 shows a plane of an additive fluid container.

FIG. 9 shows front, plan and cross-sectional views of an additive fluid container (24).

Figure 9A:
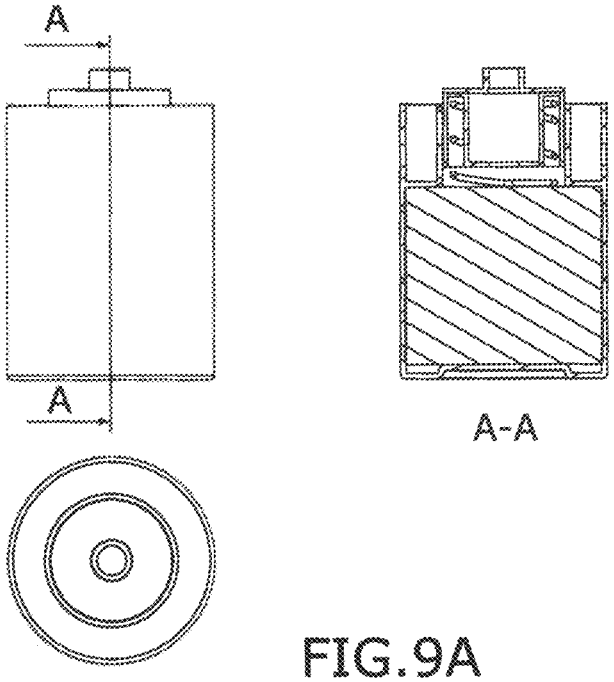
FIG. 9A shows a plane of a base fluid container.

FIG. 9A shows front, plan and cross-sectional views of a base fluid container (23).

Figure 10:
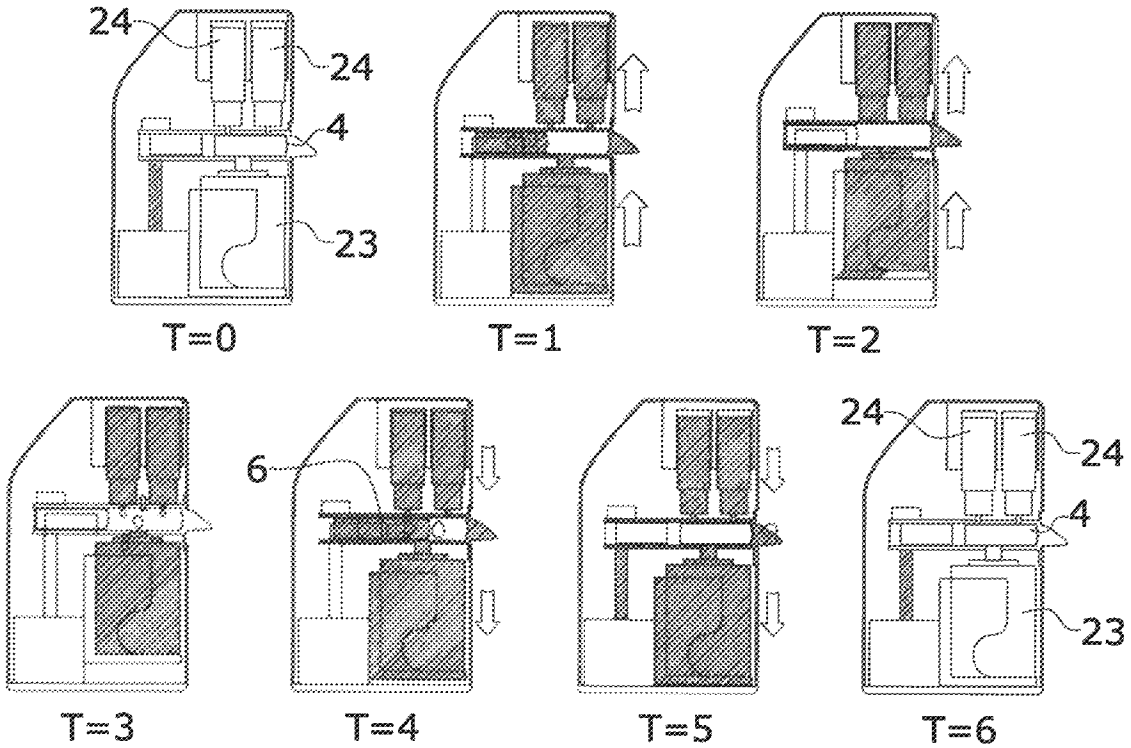
FIG. 10 shows the base fluid and additive extraction process in the sequence from T=0 to T=6, and the subsequent mixing and extruding of the end product.

FIG. 10 shows the sequence of actions taking place from the time the push button (22) (FIG. 1) in the upper portion of the casing of the device (18) is pressed until the final mixture is obtained in the dispenser (35) of the mixing tank (4).

In the initial position (T=0), the drag mechanism (2) keeps the drag element (6) extended, isolating the mixing tank (4), and the containers are relaxed. After the user presses the button (22), the operating cycle begins (T=1) with a synchronised movement comprising the retraction of the drag element (6) and compression of the containers, with the drag element reaching the fully retracted position and compression of the containers (T=2) having not yet begun. The drag system (2) disengages the drag element before compression of the containers starts, enabling all the fluids, that is, the fluids from the additive containers (24) and the fluid from the base fluid container (23), to be placed in the mixing tank (4) in front of the drag element (6) (T=3). Subsequently, the mechanism starts to move downwards, enabling decompression of the containers, and before the first module (1) and second module (3) start to separate from one another, the drag system (2) again engages the drag element (6) pushing all the fluids out of the mixing tank (4) (T=4). As a final part of the cycle, the drag element (6) extrudes all the fluids through the hole of the mixing tank (4), discharging the mixture into the dispenser (35) arranged for that purpose while the downward movement the first module (1) and second module (3) (T=5) continues until the drag element (6) is fully extended and the containers fully relaxed, reaching the starting point (T=6=0).

Figure 11:
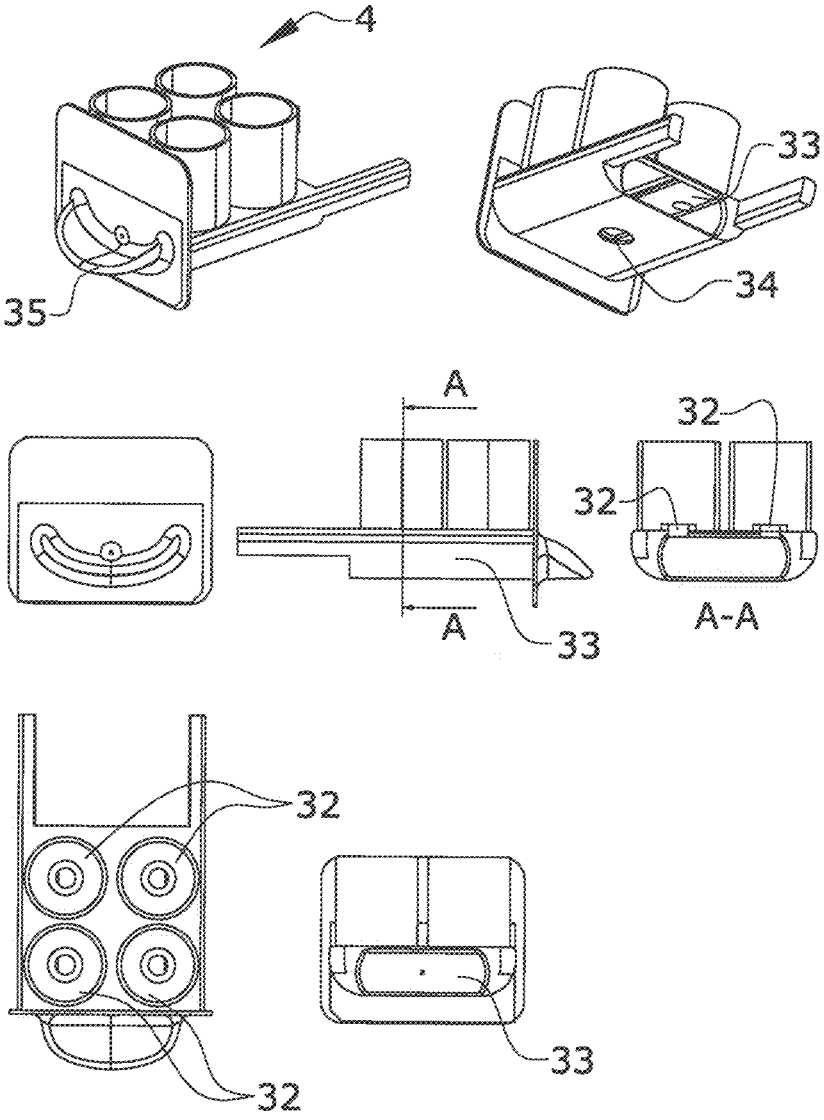
FIG. 11 shows a series of views and cross sections of the mixing tank.

FIG. 11 shows the constructive features of the mixing tank (4). It has a parallelepiped shape open at one end for movement of the drag element (6) and at the opposite end for the outlet of the final mixture, and an inner space (33) where the mixture is made being defined. The upper portion of the mixing tank (4) comprises at least one hole (32) for each inlet from the additive fluid containers, whereas for the base fluid container (23) it also features at least one hole (34) for entry of the at least one base fluid from the at least one base fluid container (23). Lastly, it features two extensions in its rear portion which serve as a support when the mixing tank (4) is extracted, enabling additive containers (24) to be changed.

The location of the inlet for the fluids to be mixed inside the mixing tank (4) through the inlet holes for the fluids is such that the inlet holes coincide with the fluid containers.

The section throughout the mixing tank (4) is constant and coincides, with the exception of fitting tolerances, with the section of the drag element (6) for exerting that piston-type drag force described above. The adjoining wall of the tank and the dispensing tab (35) has a concave shape which provides better mixing and discharge of the final mixed fluid.

Figure 12:
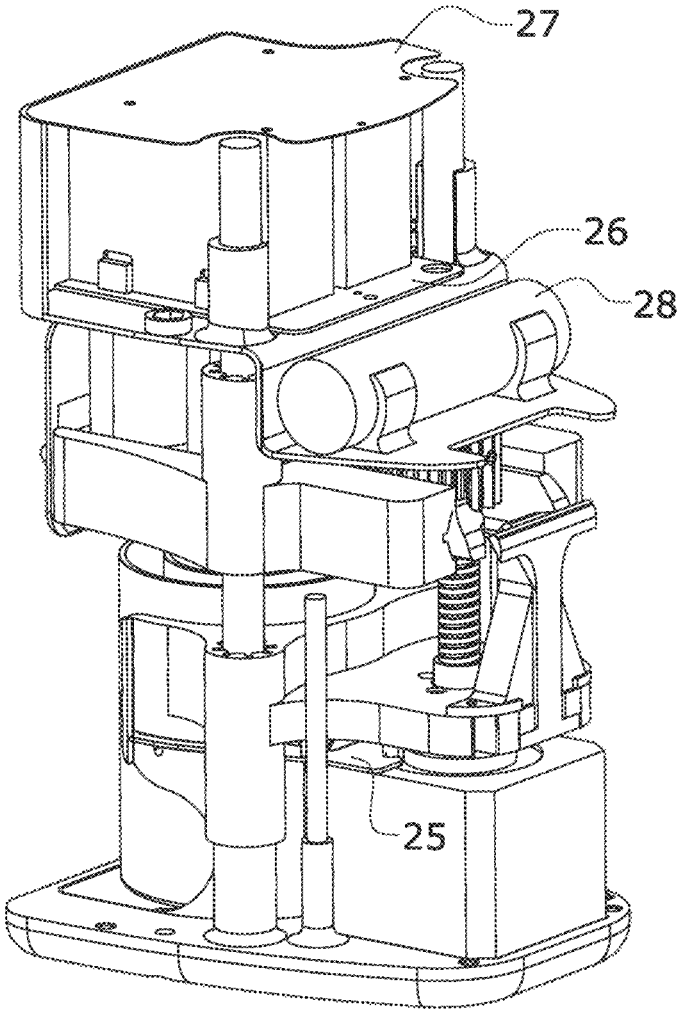
FIG. 12 shows the distribution of the electronic components in the device.

FIG. 12 shows distribution of the electronic elements in the device which allow capturing data, managing information and outputting operating and information signals to the user.

The four electronic components of the system are described. In the lower portion embedded in the first module (1), on the base fluid platform (14), is the base fluid level sensor board (25) which measures the fluid level available in the tank. The additive fluid level measurement board (26) which is embedded in the additive stop part (19) (FIG. 7) of the second module (3) performs the same function for each of the additives. The main board (27) of the system which is in charge of managing all the information from the sensor boards and informing the user through indicator LEDs (29), in addition to managing the battery charge, is located in the upper portion of the device anchored to the same part as the active ingredient sensor board. Lastly, also anchored to the same additive stop part (19) is the system battery (28), the form and nature of which are not limited to those shown in FIG. 12, although this is a preferred embodiment. The battery is in charge of powering all the electronic systems, starting with the main board, and can be charged through a microUSB connector (36) (FIG. 14) located in the main board (27), where this connector is also preferred but is non-limiting.

Figure 13:
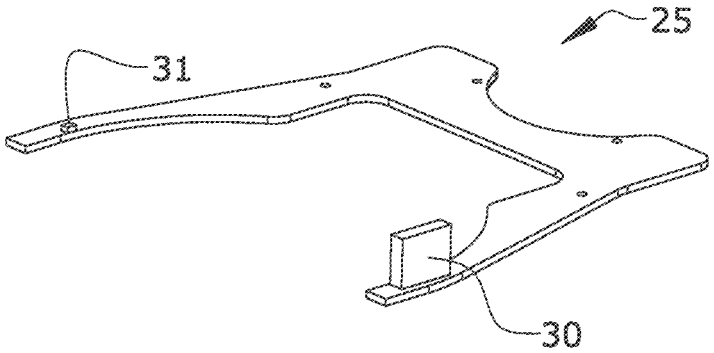
FIG. 13 describes the operation of the container level sensor, such as the base container sensor board.

FIG. 13 shows the operation of both the base fluid and additive container level sensor boards (25) (26). In the case shown, the base fluid sensor board (25) is observed. In said board there is a bent LED emitter (31) which, before starting the cycle, emits a light signal which is captured by the photoresistor (30) on the opposite side, and depending on the fluid level, said signal arrives with a given intensity or another indicating the level in the container.

Figure 14:
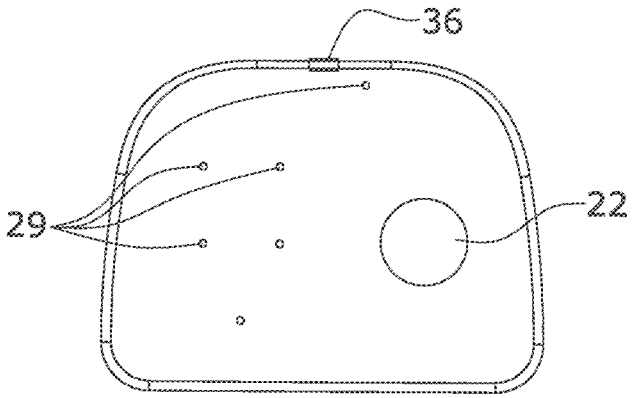
FIG. 14 describes the elements with which the user interacts and which are located in the upper portion of the device.

FIG. 14 shows the distribution of the components in the main board of the system (27) on the upper surface of the casing (18) in which the indicator LEDs (29), the capacitive button (22) and the microUSB (36) are located.

Possible cases for global operation and user indications are described in detail below.

Indicator LEDs (29): These indicate the amount of additive/base fluids of each air-less container in 4 phases (two colours: red/white):

- WHITE LED on: There is enough of all products and everything is working properly.
- WHITE LED blinking: The container is running out.
- RED LED on: Product has run out, or in the case of the base fluid, it has run out or there is no container.
- LED off: Additive container has not been introduced. In the case of the base container, this state cannot occur and its red indicator LED would also switch on in this situation.

Battery (two colours: red/white):

- LED off: The battery has sufficient charge to work properly.
- RED LED on: Insufficient battery to work.
- RED LED blinking: The battery is running out, device must be charged.
- WHITE LED blinking: Charging and connected to the current.
- WHITE LED steady: Charged 100% and connected to the current.

Having sufficiently described the nature of the present invention as well as the manner of putting it into practice, it is hereby stated that within its essential features, the invention may be carried out to practice in other embodiments which differ in detail from that indicated by way of example and which will likewise fall under the protection which is sought provided that the fundamental principle thereof has not been altered, changed or modified.

The invention claimed is:

1. A fluid mixing device comprising an outer casing or housing which comprises:

a first module provided with means for extracting at least one first fluid contained in at least one container to a mixing tank, a drag, mechanism provided with means for extrusion and discharge, which operates inside the mixing tank to transform the heterogeneity of the single doses given by each of the containers into a final homogeneous mixture, a second module provided with means for extracting one or more second fluids or additive fluids from one or more additive containers to a mixing tank, the mixing tank is provided with a hole for the discharge of a final mixture, wherein the mixing tank is detachable and removable from the first module and the second module and the end result is characterized as a homogeneous mixture of all individual components, a battery-powered electronic control board, and a single stepper motor wherein the drag mechanism being arranged inside the mixing tank and the mixing tank being located between the first module and the second module, wherein control of the device after pressing just once enables using and obtaining a mixture of fluids, the single stepper motor lifts the container causing the discharge of its contents into the mixing tank; further the one or more additive containers are pressed due to the lifting of the mixing tank discharging their contents into the mixing tank, and the drag mechanism is also operated by said stepper motor at the same time.

2. The fluid mixing device according to claim 1, wherein the first module is located in a lower portion of the device whereas the second module is located in an upper portion of the device.

3. The fluid mixing device according to claim 1, wherein the stepper motor is associated with a main gear through a spindle, wherein the main gear engages with a gear of a drag element which is fixed to the second module through a screwed shaft and allows it to engage with a rack of the drag element, thus producing sliding in a drag, extrusion and discharge direction of the drag element.

4. The fluid mixing device according to claim 3, wherein said first module comprises, a base, guides fixed to the base, a platform movable in the vertical direction along the guides by the action of the spindle and a trapezoidal nut which transform the rotation of the single stepper motor into a lifting and lowering movement of the platform, which allows all the compartments to be actuated at the same time, in the same movement, stops for limiting the lifting movement of the platform, said stops being fixed to the base, a part provided with means, which couples and decouples the drag element during the cycle so that tanks can be compressed when it is completely deployed and discharged when they are still compressed.

5. The fluid mixing device according to claim 1, wherein the second module for discharging the additive containers comprises:

a lifting and lowering platform of the mixing tank, which also performs the function of fixing the one or more additive containers, an additive stop part anchored to the outer casing, which causes the additive containers to be pressed, wherein the lifting and lowering platform corresponding to the second module also acts as a support for a portion of the drag system, since it is integral with the mixing tank.

6. The fluid mixing device according to claim 3, wherein the mixing tank has a parallelepiped shape open at one end for movement of the drag element and at the opposite end for the outlet of the final mixture, and the mixing tank comprises an inner space where the mixture is made wherein the upper portion of the mixing tank comprises at least one opening for each inlet from the one or more additive containers, and the fluid container comprises at least one opening for entry of at least one base fluid from at least one base fluid container.

7. The fluid mixing device according to claim 1, wherein the casing is provided with a series of indicator LEDs indicating amount of additive and base fluids, as well as the state of the battery; it also features a capacitive actuation button, and a door for accessing the inside, as well as a dispenser of the final mixture emerging through the door.

8. The fluid mixing device according to claim 1, wherein the device further comprises:

a base fluid level sensor board which measures a fluid level available in a tank, an additive fluid level measurement board which is embedded in an additive stop part.

9. The fluid mixing device according to claim 8, wherein each of the level sensor boards comprises a LED emitter and a photoresistor arranged facing the LED emitter.

10. The fluid mixing device according claim 1, wherein the main control board features a microUSB connector for powering the board.

* * * * *